US006059334A

United States Patent [19]

LaCourse et al.

[11] Patent Number: 6,059,334

[45] Date of Patent: May 9, 2000

[54] GOLF BALL RETRIEVER AND METHOD

[76] Inventors: Marcel M. LaCourse, deceased, late of Endwell, N.Y.; by Hilda A. LaCourse, executrix, 792 Marble Pl., Concord, N.C. 28025

[21] Appl. No.: 09/320,969

[22] Filed: May 27, 1999

[51] Int. Cl.[7] ..... A63B 47/02

[52] U.S. Cl. ..... 294/19.2; 294/66.1

[58] Field of Search ..... 294/19.1, 66.1, 294/66.2, 86.42, 77; 473/286

[56] References Cited

U.S. PATENT DOCUMENTS

| | | | |
|---|---|---|---|
| 2,027,546 | 1/1936 | Macdonald | 294/19.2 |
| 2,962,321 | 11/1960 | Fowler et al. | 294/19.2 |
| 3,029,097 | 4/1962 | Ward | 294/19.2 |
| 3,046,044 | 7/1962 | Christle | 294/19.2 |
| 3,601,920 | 8/1971 | Mason, Jr. | 294/66.1 |
| 3,743,338 | 7/1973 | Seeger | 294/19 |
| 4,058,336 | 11/1977 | Parkinson | 294/19.2 |
| 4,774,804 | 10/1988 | Sands | 56/400 |
| 5,261,434 | 11/1993 | Fodero | 135/16 |
| 5,311,733 | 5/1994 | Krenkel | 56/400 |
| 5,326,145 | 7/1994 | Lee | 294/19 |

*Primary Examiner*—Dean J. Kramer

[57] ABSTRACT

A golf ball retriever is provided which has a sinuous rigid frame and a flexible gate formed from chain links. As the ball catcher is placed over a selected ball, the gate slides over the ball whereupon lifting the ball retriever will cause the gate to close beneath the ball and hold the ball in the pocket for manually removal.

12 Claims, 5 Drawing Sheets

GOLF BALL RETRIEVER AND METHOD

BACKGROUND OF THE INVENTION

1. Field of the Invention

The invention herein pertains to a golf ball retriever and method and specifically for a golf ball retriever as may be used to remove a golf ball from a lake bed or stream.

2. Background and Objectives of the Invention

Different types of golf ball retrievers have been available for many years for removing balls from lakes, muddy surfaces and other unplayable locations. U.S. Pat. Nos. 3,743,338; 4,774,804; 5,261,434; 5,311,733; and 5,326,145 demonstrate but a few of the devices currently available. Many of the prior art devices are awkward to use in that slight ball movement will cause the retrieval to fail. Certain prior art devices are both expensive and require pressure to be placed on the ball before it can be adequately captured. Other prior art devices require great patience to use and experience in perfecting the technique employed.

Thus, with the known problems and disadvantages associated with prior art golf ball retrieving devices, the present invention was conceived and one of its objectives is to provide a golf ball retriever which is easy to use on land, in water, muddy or sandy locations.

It is still another objective of the present invention to provide a golf ball retriever which is relatively easy and inexpensive to manufacture.

It is yet another objective of the present invention to provide a golf ball retriever which does not require extreme accuracy or training for its use.

It is also an objective of the invention to provide a method of using the golf ball retriever for satisfactory results by inexperienced users.

Various other objectives and advantages of the present invention will become apparent to those skilled in the art as more detailed presentation is set forth below.

SUMMARY OF THE INVENTION

The above objectives and advantages are realized by the golf ball retriever provided which includes a ball catcher attached to the end of an extendable handle. The handle may for example, extend sixteen feet (4.8 meters) for use in ponds or other relatively inaccessible areas. A ball catcher attached at the terminal end of the handle includes a rigid, lower circular rim affixed by several short lengths of chain to a "gate" also formed from links of chain. As the chains are flexible, the gate will open and close, depending on the stresses thereon. The gate is sized to allow the diameter of a golf ball to readily pass therethrough when it is fully opened, but when partially closed, will not allow the ball to pass through. The gate is joined to a ball pocket thereabove which has a rigid wire frame therearound.

In use, the lower circular rim of the ball catcher is placed over a golf ball and the catcher is then lowered collapsing the supporting chains attached to the rim whereby the gate will fully open and allow the ball to pass upwardly therethrough to the pocket. Then, by lifting the handle, the gate will close as gravity pulls on the lower rim extending the chains attached to the gate, causing the ball to be trapped in the pocket where it can be easily extracted by hand.

BRIEF DESCRIPTION OF THE DRAWINGS

FIG. 5 demonstrates a top view of the ball catcher with the gate partially closed as normal which would prevent a ball from passing through.

DETAILED DESCRIPTION OF THE PREFERRED EMBODIMENTS AND OPERATION OF THE INVENTION

Figure 1:
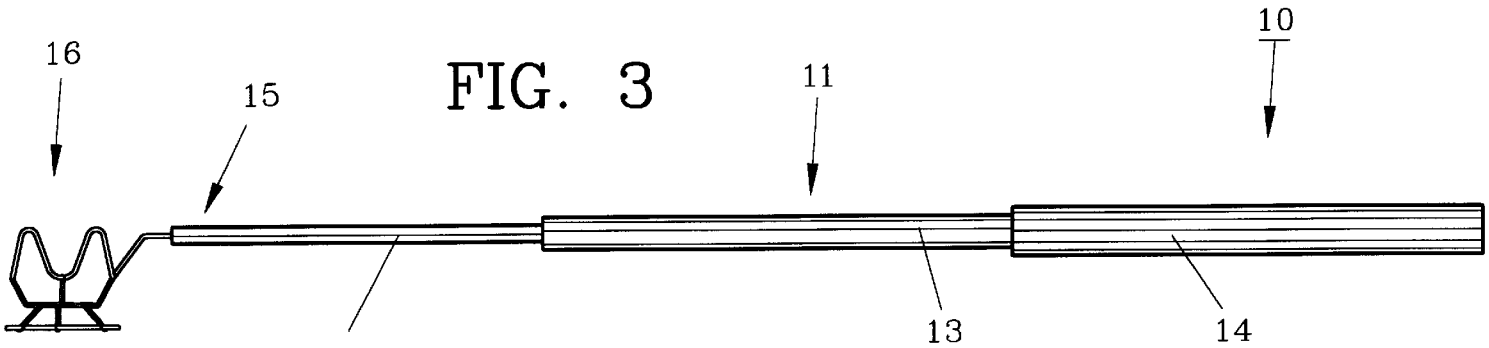
FIG. 1 illustrates a side view of the golf ball retriever with the telescoping handle fully extended.

For a better understanding of the invention and its operation, turning now to the drawings, FIG. 1 illustrates a side view of preferred golf ball retriever 10 having a telescoping handle 11 formed of tubular aluminum sections 12, 13 and 14 which may collectively extend to a length of approximately sixteen feet (4.8 meters) and in collapsed form may be no more than six feet (1.82 meters) in length.

Figure 3:
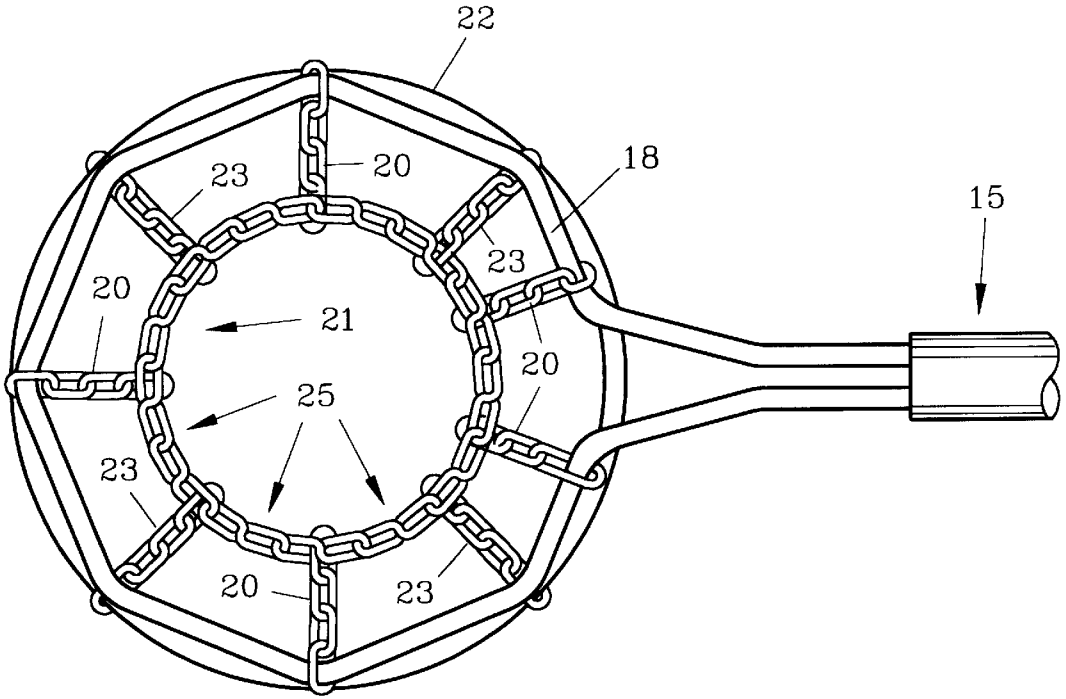
FIG. 3 demonstrates a top view of the enlarged ball catcher with the gate fully opened.
Figure 2:
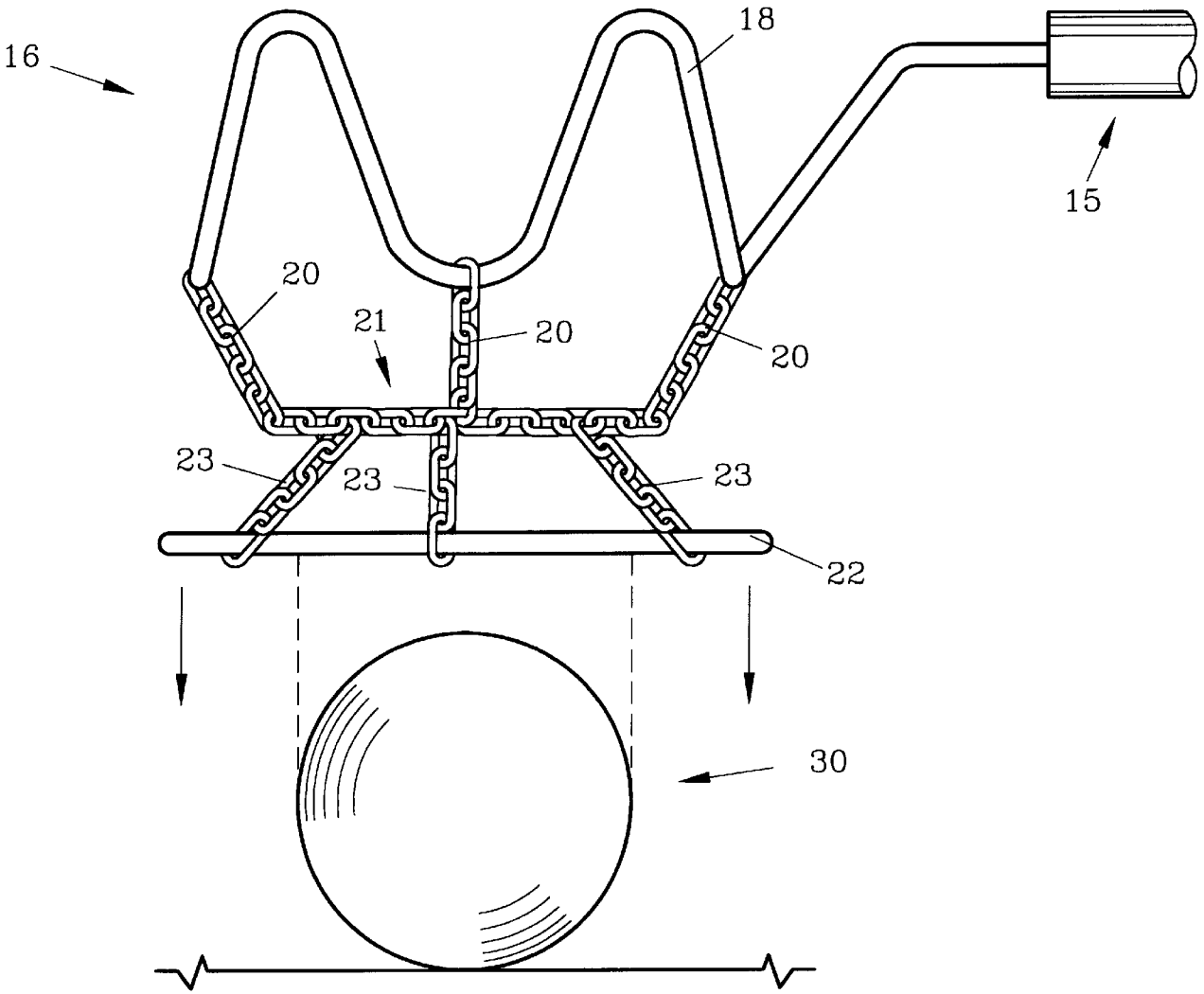
FIG. 2 demonstrates an enlarged view of the ball catcher prior to placement over a golf ball.

At the distal end 15 of telescoping handle 11 ball catcher 16 is positioned which is shown in more detail in FIG. 2. Ball catcher 16 includes an upper pocket formed by rigid stainless steel wire frame 18 which is sinuous in shape and is joined by metal link chains 20 to gate 21 also formed from a metal link chain for flexibility purposes. Gate 21 having a plurality of articulation 25 is shown in a circular shape in FIG. 3 but, upon application of pressure or weight as is normal, changes shape and is reduced in dimension to a more elongated or oval configuration as seen in FIG. 5.

In FIG. 2, ball catcher 16 is seen descending to surround ball 30 which may be a golf ball at the bottom of a relatively shallow pond. Ball catcher 16 further comprises circular rim 22 which is also formed from stainless steel and is joined to ball catcher 16 via flexible chain links 23. Rim 22 has a diameter much greater than ball 30 to allow ease in use.

Figure 4:
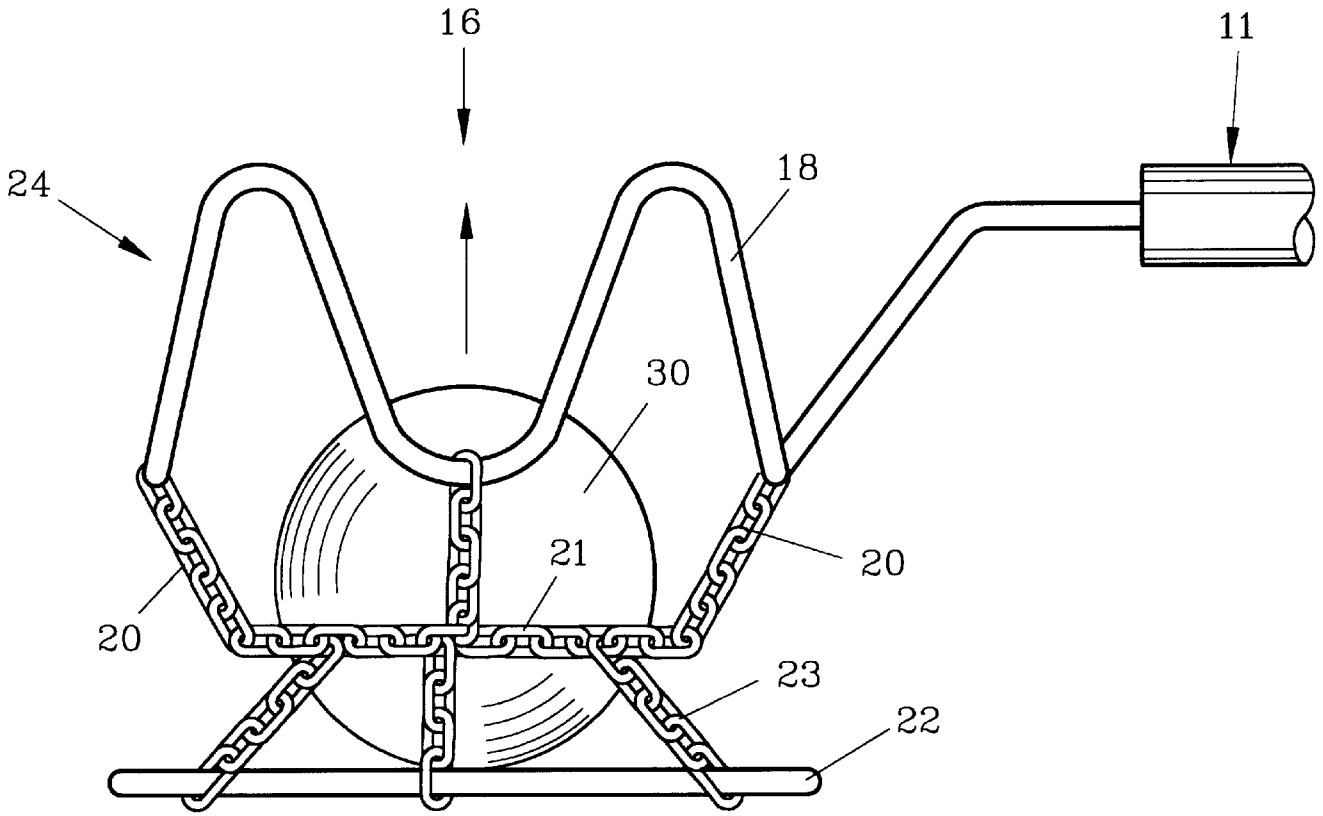
FIG. 4 depicts the ball catcher as in FIG. 3 in the initial stages of capturing a golf ball.

In FIG. 4, ball 30 has now passed beyond rim 22 and has partially passed through one-way gate 21 into pocket 24. Pocket 24 is formed by sinuous frame 18, chains 20 and gate 21.

Figure 5:
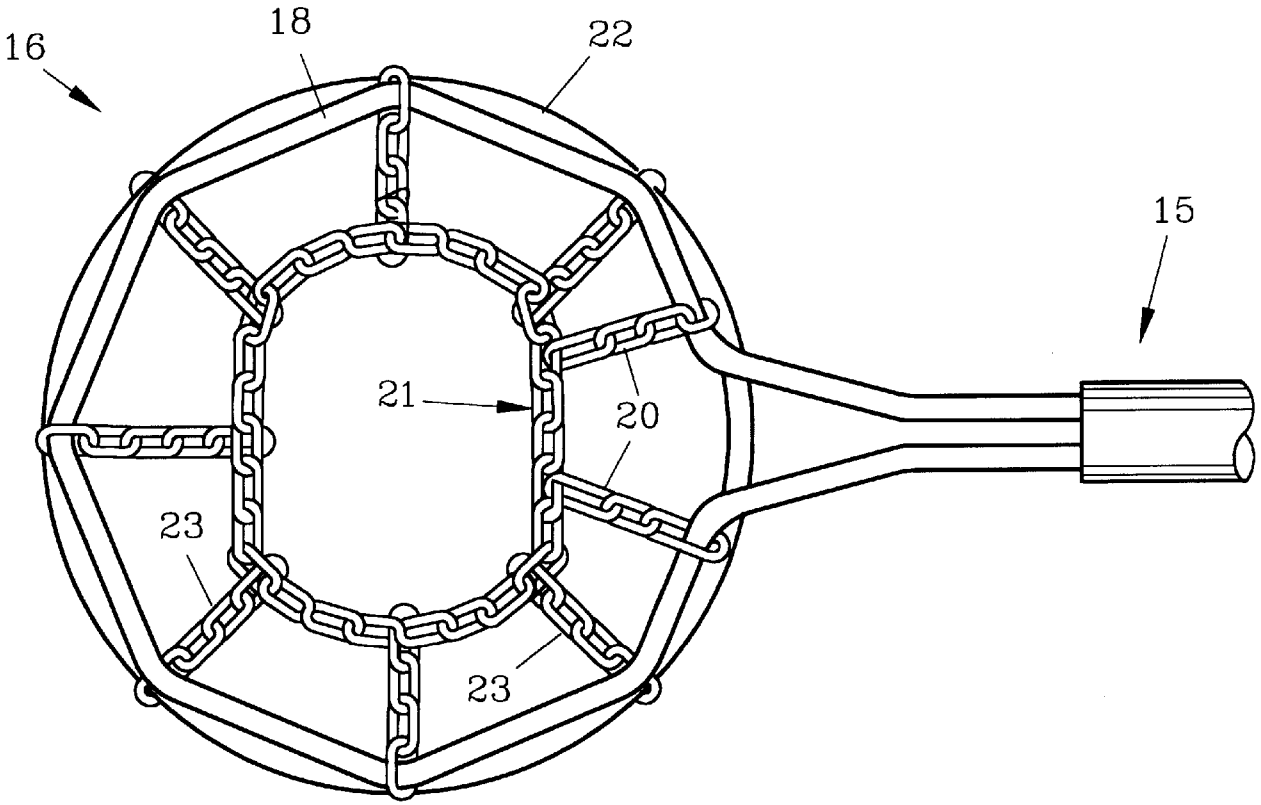
Figure 6:
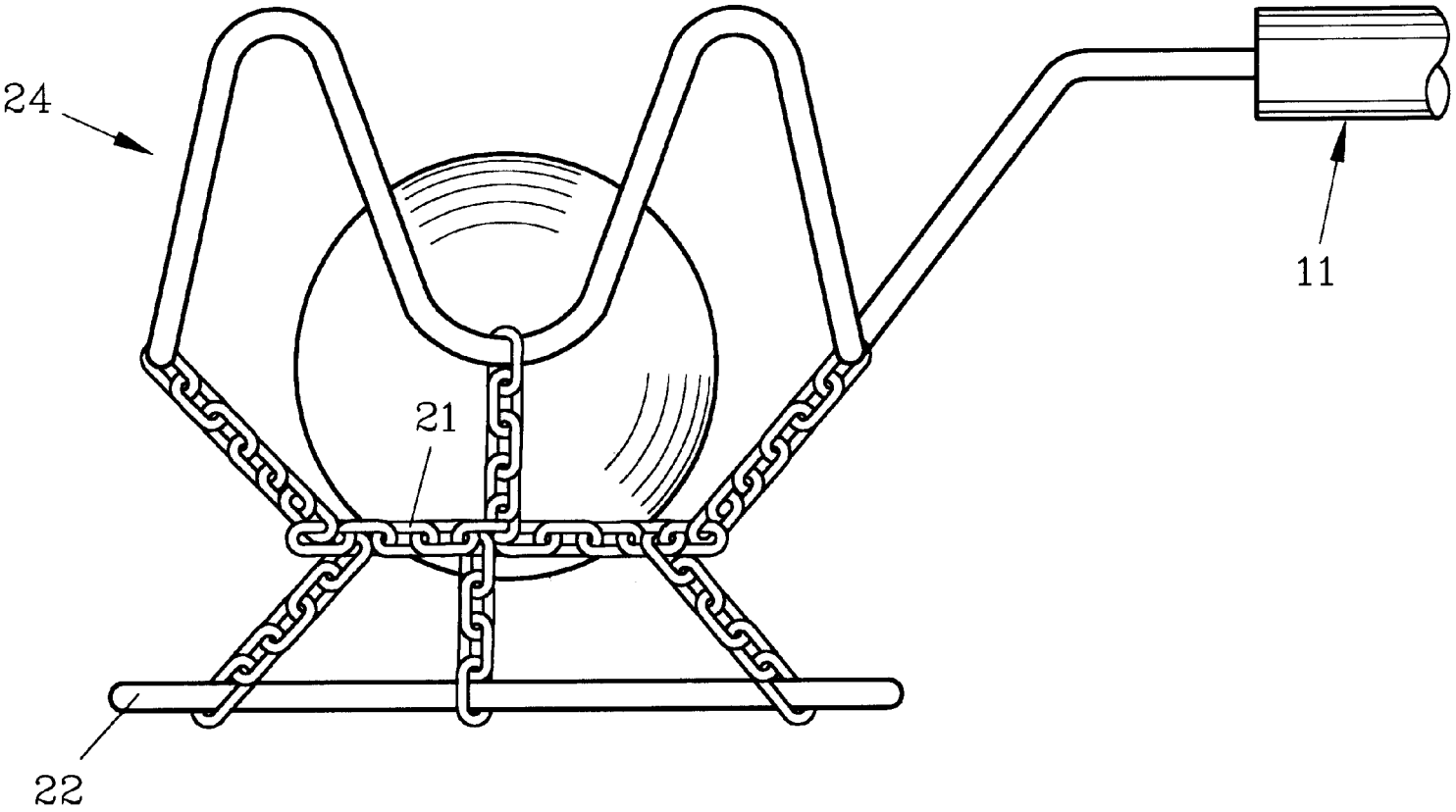
FIG. 6 demonstrates a side view of the ball catcher as shown in FIG. 5 with a golf ball ensnared therein.

After ball 30 continues its upward path into pocket 24 by lowering ball catcher 16, gate 21 closes to a configuration as shown in FIG. 5 due to the downward force applied by rim 22 and chains 23 as retriever 10 is raised. The downward force provided by rim 22 and chain links 23 upon raising distort the circular opening of gate 21 thus preventing ball 30 from falling therethrough. The force of gravity acts to close gate 21 behind captured ball 30 so ball 30 can then be removed from its location and extracted from ball catcher 16 by hand with ease.

The preferred method of retrieving a golf ball with ball retriever device 10 as described in FIGS. 1–6 provides placing rim 22 over ball 30 which has come to rest at the bottom of a pond or other undesirable location by manipulating handle 11, lowering ball catcher 16 onto ball 30, allowing ball 30 to pass upwardly through rim 22 and past gate 21 into pocket 24 of ball catcher 16, and thereafter closing gate 21 by lifting ball catcher 16 with handle 11. Next, the captured ball can be manually extracted from catcher 16.

The illustrations and examples provided herein are for explanatory purposes and are not intended to limit the scope of the appended claims.

I claim:

1. A golf ball retriever comprising: a handle, a ball catcher, said ball catcher attached to said handle, said ball catcher comprising: a rim, a ball pocket, said rim attached to said ball pocket, a one-way gate, said gate comprising articulations, said gate positioned between said rim and said pocket to allow a golf ball to pass through said rim to said pocket.

2. The golf ball retriever as claimed in claim 1 wherein said gate comprises a flexible member.

3. The golf ball retriever as claimed in claim 1 wherein said ball catcher comprises a rigid rim.

4. The golf ball retriever as claimed in claim 1 wherein said ball pocket comprises a wire frame.

5. The golf ball retriever as claimed in claim 1 wherein said gate is formed from a link chain.

6. A golf ball retriever comprising: a handle, a ball catcher, said handle attached to said ball catcher, said catcher comprising a rim, a ball pocket, said pocket attached to said rim, a one-way flexible gate, said gate comprising articulations, said gate positioned between said rim and said ball pocket, whereby a ball passing through said rim will pass through said gate to said pocket and said gate upon closing will prevent said ball from passing from said pocket to said rim.

7. The golf ball retriever as claimed in claim 6 wherein said flexible gate is formed from a link chain.

8. The golf ball retriever as claimed in claim 7 wherein said chain comprises a metal chain.

9. The golf ball retriever as claimed in claim 6 wherein said handle is telescopic.

10. A method of retrieving a golf ball with a device having a handle and a ball catcher having a flexible gate with articulations connected to a rim comprising the steps of:

(a) allowing a ball to pass through the rim and the gate; and (b) closing the gate.

11. The method of claim 10 wherein allowing the ball to pass through the gate comprises the step of manipulating the ball catcher with the handle to a position over the ball.

12. The method of claim 10 and including the step of removing the ball from the ball catcher.

* * * * *